United States Patent [19]

Gaskill

[11] 4,157,706

[45] Jun. 12, 1979

[54] WATER HEATER

[76] Inventor: Emanuel P. Gaskill, 15 Bay Ave., Somers Point, N.J. 08244

[21] Appl. No.: 901,192

[22] Filed: Apr. 28, 1978

[51] Int. Cl.[2] ..... F24S 3/02; F22B 9/00

[52] U.S. Cl. ..... 126/271; 122/20 B; 122/155 A; 122/367 C

[58] Field of Search ..... 122/20 B, 155 A, 367 C; 126/271

[56] References Cited

U.S. PATENT DOCUMENTS

| | | | |
|---|---|---|---|
| 167,852 | 9/1875 | Moore | 126/5 |
| 515,640 | 2/1894 | Austin | 126/365 |
| 854,385 | 5/1907 | Sanders | 126/365 X |
| 956,934 | 5/1910 | Busey et al. | 122/20 |
| 1,150,522 | 8/1915 | Jackson et al. | 126/365 X |
| 1,161,855 | 11/1915 | Gilkey | 126/365 |
| 1,338,644 | 4/1920 | Arthur et al. | 126/271 |
| 1,438,260 | 12/1922 | Pilcher | 122/20 |
| 1,865,852 | 7/1932 | Goldhagen | 122/20 X |
| 1,880,533 | 10/1932 | Thomas | 122/367 C |
| 1,888,620 | 11/1932 | Clark | 126/271 |
| 2,080,229 | 5/1937 | Ray | 122/20 |
| 2,554,338 | 5/1951 | Levine | 122/20 |
| 2,620,431 | 12/1952 | Shepheard | 122/20 X |
| 3,580,225 | 5/1971 | Coy | 122/20 |
| 3,793,992 | 2/1974 | Marquez | 122/20 |
| 3,987,761 | 10/1976 | Downs et al. | 122/20 |
| 3,991,821 | 11/1976 | Cook et al. | 122/20 |
| 4,037,567 | 7/1977 | Torres | 122/20 |

OTHER PUBLICATIONS

Publication by Grumman Energy Systems, Inc., Ronkonkoma, New York, reference No. KHA-12-77.

*Primary Examiner*—Kenneth W. Sprague

*Attorney, Agent, or Firm*—Thomas C. Naber

[57] ABSTRACT

A water heater capable of utilizing as one of its heat sources hot exhaust gases emitted from at least one other heat source such as a furnace fueled by a natural resource fuel such as gas or oil, and capable of utilizing as another of its heat sources heat emitted from a fluid heated by solar energy. The water heater comprises a central flue having a heat conductive wall, one end of the said flue having a thimble member secureable to an exhaust pipe carrying hot exhaust gases from a heat source fueled by a natural resource fuel, and the other end of said flue secureable to a chimney leading to the atmosphere. Disposed within the flue is a turbulator means which disperses entering hot exhaust gases along the surface of the flue wall. A fluid tight tank for water surrounds the central flue, said tank having as its inner wall the wall common to the flue and having a heat conductive outer wall, and having an inlet pipe at the bottom of the tank for entrance of water under pressure and an outlet pipe at the top for exit of water under pressure. Disposed within the tank is a turbulator means which disperses entering water along the interior surfaces of the inner and outer tank walls. Surrounding and in contact with the outer wall of the tank is a hollow jacket to house fluid which is to be in communication with like fluid within a solar heat collection means, with the walls of said jacket being heat conductive. Said fluid is made to circulate between the jacket and the solar heat collection means by means of a circulator which is activated thermostatically only above selected temperatures of the fluid situated within the solar heat collection means, the water to be heated, and the gases within the flue. Finally, insulation means which inhibits heat conduction surrounds the jacket.

4 Claims, 3 Drawing Figures

WATER HEATER

This invention relates to a water heater which is capable of (1) utilizing hot exhaust gases from a combustion heat source, and (2) utilizing solar heated fluid as its sources of heat.

BACKGROUND OF THE INVENTION

Maximum utilization of heat energy, whether it be produced by combustion of fuels or by the sun, is an important goal, both from a conservation standpoint and from an economic standpoint. One high heat energy requirement is found in the heating of water, especially for domestic use in the home. Specifically, water made available to a home from a water main or a well is generally at a temperature of 50° to 70° F. The temperature of this water must then be elevated to 130° to 150° F. for use in the kitchen, bathroom, etc.

A quantity of the heat energy generated in a furnace used for general heating and which is fueled by a natural resource fuel such as coal, gas or oil is lost to the atmosphere via hot exhaust gases passing through the flue and chimney leading from the combustion chamber of the furnace to the atmosphere. Likewise, should a conventional hot water heater which is directly fueled by a natural resource fuel be utilized, a quantity of the heat energy generated in heating the water is also similarly lost to the atmosphere.

It is therefore an object of the invention disclosed herein to utilize the hot exhaust gases so described as a heat source for heating water. It is a further object of this invention to utilize heat from the sun, commonly termed solar energy, as a heat source for heating water. These and other objects will become apparent throughout the body of this application.

SUMMARY OF THE INVENTION

The subject of this invention is a water heater capable of utilizing as one of its heat sources hot exhaust gases emitted from at least one other heat source as a furnace fueled by a natural resource fuel, and capable of utilizing as another of its heat sources heat emitted from a fluid heated by solar energy, the water heater comprising:

a. a central flue having a heat conductive wall, one end of said flue having a thimble member secureable to an exhaust pipe carrying hot exhaust gases emitted from at least one heat source fueled by a natural resource fuel and the other end of said flue secureable to a chimney leading to the atmosphere, said flue having disposed therein for substantially the entire length of the flue a turbulator means which disperses entering hot exhaust gases along the interior surface of the wall of the flue for substantially the entire length of the flue;

b. a fluid tight tank for water, said tank surrounding the central flue and having as its inner wall the wall common to the flue and having a heat conductive outer wall, said tank also having an inlet pipe at its bottom through which water under pressure from a water source can enter and having an outlet pipe at its top through which said water can exit under pressure, and said tank having disposed therein a turbulator means which disperses entering water along the interior surfaces of the inner and outer tank walls;

c. a hollow jacket surrounding and in contact with the outer wall of the tank, said jacket having heat conductive walls and having fluid inlet and outlet means, said jacket to house fluid to be in communication with like fluid within a solar heat collection means;

d. a circulator means to draw fluid from the jacket and force said fluid into the solar heat collection means while concurrently drawing fluid from the solar heat collection means and forcing said fluid into the jacket, said circulator means being thermostatically activated by thermostatically adjustable temperature sensors independently adjustable and situated to measure temperatures of the fluid within the solar heat collection means, the water exiting the tank, and the gases within the flue, respectively; and e. insulation means surrounding and in contact with the jacket, said insulation means inhibiting heat conduction to the ambient.

One anticipated use of the water heater disclosed herein is in the capacity of a pre-heater which heats water before said water enters a conventional hot water heater from which the water is subsequently distributed. The phrase "conventional hot water heater" is meant to include water heaters utilizing electricity or a natural resource fuel for producing heat.

In a preferred mode, hot exhaust gases entering the central flue above described are derived both from a conventional hot water heater fueled directly by a natural resource fuel and from a furnace also fueled by a natural resource fuel and otherwise used to heat a home or building. The exhaust pipes from the conventional hot water heater so fueled and from the furnace are each connected to a single exhaust pipe to which the central flue of the instant invention is secured via the thimble member disclosed above. In this manner a maximum quantity of hot exhaust gases emitted from heat sources can be utilized. Because colder months necessitate more frequent furnace operation, it can be seen that during the winter months a larger quantity of hot exhaust gases will be available to heat the water present in the water heater of the instant invention. Furthermore, in many areas, there is a greater amount of cloud cover during the colder winter months, thereby decreasing available solar energy, resulting in the primary heat source for the instant water heater being the hot exhaust gases so described and especially those from the furnace. Conversely, in the warmer summer months the furnace is generally not in operation and the amount of cloud cover is generally reduced to provide increased availability of solar energy, resulting in the primary heat source for the instant water heater being the solar energy so described. Because the circulator circulating the fluid between the jacket and solar heat collection means is thermostatically activated, only adequately heated fluid is drawn to act as a heat source from solar energy. It is estimated that the water heater of the instant invention will be substantially operable nine to ten months of the year, and marginally operable the remaining two to three months because of possible warm cloud-covered days. Of course, if a conventional hot water heater fueled directly by a natural resource fuel is utilized, during marginal operation referred to above the conventional heater will be in operation and its emitted hot exhaust gases will pass through the flue of the instant invention for utilization. It is to be noted that any estimates of operability are dependent on weather conditions, and that the above monthly estimates are based on the traditional cold-winter, warm-summer weather cycle experienced by many geographical areas. It is to be further noted that the instant invention does not require more than one heat source emitting hot exhaust gases. Thus, hot exhaust gases solely from a furnace or solely from a conventional hot water heater directly fueled by a natural resource fuel can be utilized.

DRAWINGS OF A PREFERRED EMBODIMENT

DETAILED DESCRIPTION OF A PREFERRED EMBODIMENT

Figure 1:
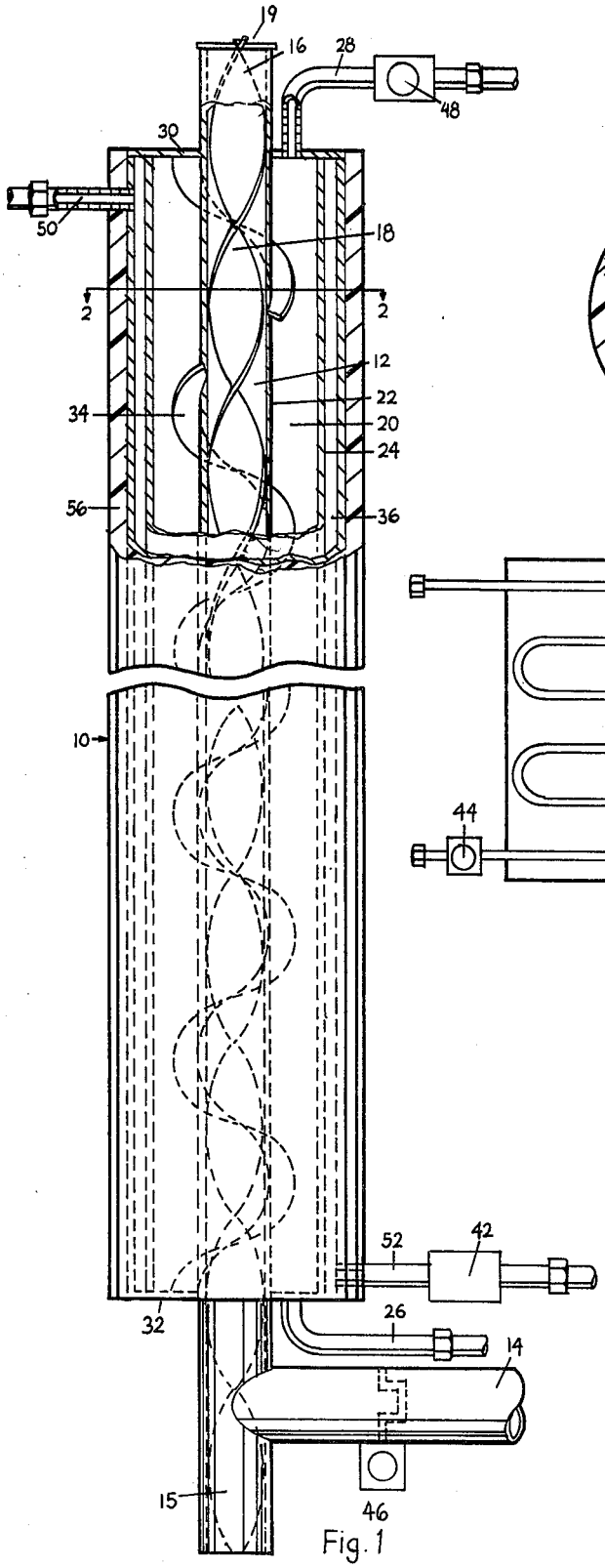
FIG. 1 is a perspective view partially in section of a water heater as described herein.

In FIG. 1 a water heater 10 having a central flue 12 with thimble member 14 at one end is shown. The thimble member 14 of the flue 12 is secureable to an exhaust pipe carrying hot exhaust gases emitted from at least one heat source such as a furnace. Tight securement of the thimble member 14 to such an exhaust pipe can be performed as known in the art with gaskets, bands, and the like. Extending downwardly below the thimble member 14 in the preferred embodiment is a condensation passage 15 in communication with the flue. This passage 15 carries for drainage condensation which may form within the flue.

Figure 2:
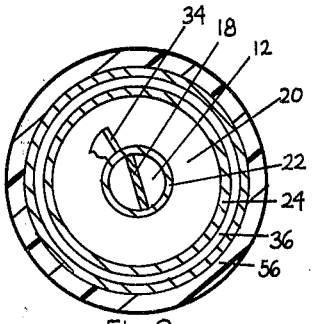
FIG. 2 is a top plan view along line 2—2 of FIG. 1.

The other end 16 of the flue 12 is secureable as known in the art to a chimney leading to the atmosphere. Disposed within the flue 12 is a turbulator means 18 substantially the length of the flue 12. Said turbulator means 18 disperses entering hot exhaust gases along the surface of the wall 22 of the flue 12 for substantially the entire length of the flue. In the preferred embodiment shown, the turbulator means 18 is a thin spiraled member, ¼ inch (0.635 cm.) thick, preferably stainless steel, whose width is slightly less than the diameter of the flue 12, thereby utilizing the flue wall 22 as its lateral support. The turbulator means 18 shown is further held in place by means of a pin 19 extending through the turbulator means 18 near its top. Each end of the pin 19 rests on the top of the flue wall 22. This turbulator means 18 is also shown in FIG. 2. While the turbulator means shown is a preferred means, it is to be understood that other turbulator means as would be apparent to the skilled artisan can be employed within the scope of the instant invention. The wall 22 of the flue 12 is heat conductive.

Surrounding the flue 12 is a fluid tight tank 20 for water, with said tank's inner wall 22 being the wall common to the flue 12 and whose outer wall 24 is heat conductive. The tank 20 has an inlet pipe 26 at its bottom through which water under pressure within a pipe leading from a water main or pumping well can enter. The tank 20 additionally has an outlet pipe 28 at its top through which water from the tank 20 can exit. Water from a water main generally will enter the tank 20 at 42 to 48 pounds per square inch pressure. This pressure is substantially maintained within the tank 20 so that water exiting through the outlet pipe 28 will do so under pressure. Upon exiting the tank 20 through the outlet pipe 28, water will flow through a water transmission pipe secured to the outlet pipe 28 to a conventional hot water heater for subsequent maintenance or elevation of temperature as required for subsequent use.

In the preferred embodiment, the walls 22, 24 and the top 30 and bottom 32 are constructed of stainless steel or other non-corrosive material, with the top 30 and bottom 32 of the tank 20 being joined to the walls 22, 24 in any fluid tight manner known in the art as, for example, being welded. Within the tank 20 is disposed a turbulator means 34 which disperses water entering through the inlet pipe 26 along the interior surfaces of the tank walls 22, 24. In the preferred embodiment shown, the turbulator means 34 is comprised of a continuous metal ledge situated in a spiral configuration along the surface of the inner wall 22. The turbulator means 34 is likewise made of stainless steel or other non-corrosive material, and is secured to the wall 22 in any manner known in the art as, for example, being welded. The turbulator means 34 extends outwardly from the wall 22 1¼" (3.175cm.) and has a thickness of ¼" (0.635cm.). While the turbulator means 34 shown is a preferred means, it is to be understood that other turbulator means as would be apparent to the skilled artisan can be employed within the scope of the instant invention. Heat from the hot exhaust gases in the flue 12 is conducted through the wall 22 to the water within the tank 20. FIG. 2 illustrates from above the placement of the turbulator means 34.

Figure 3:
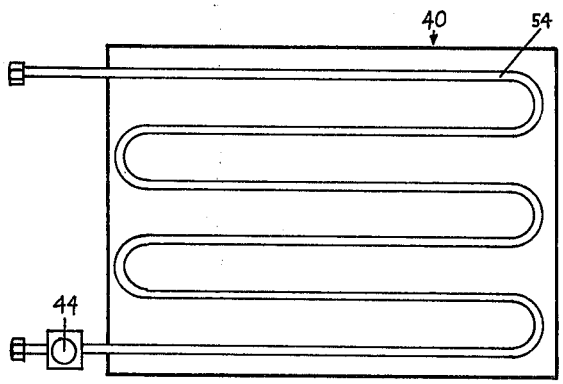
FIG. 3 is a top plan view of a solar collection means.

Surrounding and in contact with the outer wall 24 of the tank 20 is a hollow jacket 36 to house fluid, said jacket 36 having heat conductive walls. The wall of the jacket 36 nearer the tank 20 can be a wall common to the outer wall 24 of the tank 20, as shown in the preferred embodiment, or the wall nearer the tank can be a separate wall. In operation, fluid within the jacket 36 is in communication with like fluid within a solar heat collection means 40, an example of said means 40 being shown in FIG. 3. The fluid can be water, ethylene glycol mixture, or any liquid or gaseous fluid capable of being conveniently and safely circulated between the jacket 36 and the solar collection means 40 in view of ambient conditions. A thermostatically activated electrically operated circulator 42 as known in the art has one temperature sensor 44, a strap-type sensor, disposed at the solar collection means 40. The circulator 42 has a second temperature sensor 46 disposed within the thimble member 14, and a third temperature sensor 48, a strap-type snesor, disposed at the outlet pipe 28 leading from the tank 20. Only when the fluid in the solar collection means 40 meets or exceeds a pre-selected temperature which effectuates warming of water in the tank 20 and which is of a value higher that the temperature of the water leaving the tank 20 and of the gases present in the thimble member 14 will the circulator operate to bring the warmed fluid to the jacket 36. This warmed fluid will, of course, displace the fluid in the jacket 36, with said fluid in the jacket going to the solar collection means 40 for subsequent like warming. In the preferred embodiment shown, warmed fluid enters the top of the jacket 36 through inlet means consisting of an inlet pipe 50 and travels throughout the jacket to outlet means consisting of an outlet pipe 52, displacing, as noted above, fluid previously in the jacket 36, which fluid goes to the solar collection means 40. When this occurs, the fluid in the solar collection means is then below the pre-selected circulator action temperature, thereby causing the circulator to stop operation and keep the fluid stationary to permit conduction of heat from the fluid in the jacket 36 to water within the tank 20. Transmission pipes through which the fluid travels are disposed between the solar collection means 40 and the jacket 36 as known in the art, with the solar collection means mounted on a roof or similarly to be exposed to a maximum amount of sunshine. In this preferred embodiment, the solar collection means 40 is comprised of suitable tubing 54. It is to be understood, however, that the solar collection means can be any of those known in the art or apparent to one skilled in the art and applicable to the instant invention without departing from the scope of this invention.

Thermostatically controlled circulators and temperature sensor apparatus as described above are known in the art and are available commercially. The circulator 42 in this preferred embodiment is situated on the outlet pipe 52 leading from the jacket 36. It is to be understood, however, that the circulator 42 can be disposed as desired between the jacket 36 and the solar collection means 40. The sensors 44, 48 are strap type as known in the art to measure the temperature of the outside of the fluid-bearing solar collection means tubing 54 and the outlet pipe 28 of the tank 20, respectively. The temperature sensor 46 which measures the temperature of the hot exhaust gases is a probe which is disposed within the thimble member 14 of the flue 12. An illustrative, but not limiting, example of respective thermostat settings and circulator operation is as follows. The sensor 44 disposed at the solar collection means 40 may be set at 110° F. Concurrently, the sensor 46 disposed within the thimble member 14 may be set at 150° F., while the sensor 48 disposed at the outlet pipe 28 leading from the tank 20 may be set at 100° F. In this foregoing example, the only time the circulator 42 would be in operation would be when the fluid in the solar collection means is at least 110° F., the gases within the thimble member are below 150° F., and the water in the outlet pipe leading from the tank is below 100° F. In this manner, solar heated fluid is utilized only when it can heat the water and when it can do so more effectively that hot exhaust gases within the flue.

Surrounding and in contact with the jacket 36 is insulation means 56 to inhibit heat conduction to the ambient. In the preferred embodiment the insulation means 56 is, as known in the art, fiberglass which is capable of withstanding the temperatures herein involved. The insulation means 56 is tightly and firmly applied as known in the art to keep it in place. As desired or practical, insulation means can be fitted in contact with the top 30 and bottom 32 of the tank 20, as well as in contact with the thimble member 14 and any portion of the flue 12 not surrounded by the tank 20.

In the embodiment of the water heater 10 shown, the tank 20 is 8 feet (2.44 meters) tall, the flue 12 has a diameter of 5 inches (12.7 centimeters), and the tank-plus-flue diameter is 18 inches (45.7 centimeters). It is to be understood, however, that both size and shape can be varied as would be apparent to the skilled artisan and still provide satisfactory results. The water heater herein described can be placed in a basement, closet, outside a structure, etc.

In the foregoing description it is to be understood that said description is illustrative and not limiting, and that the claims which follow are intended to define the scope of the instant invention.

What is claimed is:

1. A water heater capable of utilizing as one of its heat sources hot exhaust gases emitted from at least one other heat source such as a furnace fueled by a natural resource fuel, and capable of utilizing as another of its heat sources heat emitted from a fluid heated by solar energy, the water heater comprising:

a. a central flue having a heat conductive wall, one end of said flue having a thimble member secureable to an exhaust pipe carrying hot exhaust gases emitted from at least one heat source fueled by a natural resource fuel and the other end of said flue secureable to a chimney leading to the atmosphere, said flue having disposed therein for substantially the entire length of the flue a turbulator means which disperses entering hot exhaust gases along the interior surface of the wall of the flue for substantially the entire length of the flue;

b. a fluid tight tank for water, said tank surrounding the central flue and having as its inner wall the wall common to the flue and having a heat conductive outer wall, said tank also having an inlet pipe at its bottom through which water under pressure from a water source can enter and having an outlet pipe at its top through which said water can exit under pressure, and said tank having disposed therein a turbulator means which disperses entering water along the interior surfaces of the inner and outer tank walls;

c. a hollow jacket surrounding and in contact with the outer wall of the tank, said jacket having heat conductive walls and having fluid inlet and outlet means, said jacket to house fluid to be in communication with like fluid within a solar heat collection means;

d. a circulator means to draw fluid from the jacket and force said fluid into the solar heat collection means while concurrently drawing fluid from the solar heat collection means and forcing said fluid into the jacket, said circulator means being thermostatically activated by thermostatically adjustable temperature sensors independently adjustable and situated to measure temperatures of the fluid within the solar heat collection means, the water exiting the tank, and the gases within the flue, respectively; and e. insulation means surrounding and in contact with the jacket, said insulation means inhibiting heat conduction to the ambient.

2. A water heater as claimed in claim 1 wherein the turbulator means disposed within the flue is a thin spiraled member.

3. A water heater as claimed in claim 1 wherein the turbulator means disposed within the tank is a continuous ledge situated in a spiral configuration along the surface of the inner wall of the tank.

4. A water heater as claimed in claim 1 wherein the wall of the jacket nearer the tank is common to the outer wall of the tank.

* * * * *